US007588243B2

(12) United States Patent
Nemoto et al.

(10) Patent No.: US 7,588,243 B2
(45) Date of Patent: Sep. 15, 2009

(54) SHEET FEEDING APPARATUS AND IMAGE FORMING APPARATUS

(75) Inventors: Akio Nemoto, Susono (JP); Hironobu Ata, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 456 days.

(21) Appl. No.: 11/404,888

(22) Filed: Apr. 17, 2006

(65) Prior Publication Data

US 2006/0237893 A1 Oct. 26, 2006

(30) Foreign Application Priority Data

Apr. 26, 2005 (JP) ..... 2005-128407

(51) Int. Cl.
*B65H 3/44* (2006.01)
*B65H 1/00* (2006.01)

(52) U.S. Cl. ..... 271/9.11; 271/162

(58) Field of Classification Search ..... 271/9.11, 271/162, 164, 167
See application file for complete search history.

(56) References Cited

U.S. PATENT DOCUMENTS 3,977,666 A * 8/1976 Suzuki et al. ..... 271/9.11
4,548,394 A * 10/1985 Koyama et al. ..... 271/9.11
6,148,172 A * 11/2000 Kanda et al. ..... 399/391
6,273,414 B1 * 8/2001 Matsuo ..... 271/9.11
7,226,050 B2 6/2007 Sekiyama et al. ..... 271/213
7,237,774 B2 7/2007 Fukatsu et al. ..... 271/207
2005/0220521 A1 10/2005 Kuwata et al. ..... 399/407
2006/0071423 A1 4/2006 Ata et al. ..... 271/303

FOREIGN PATENT DOCUMENTS

JP 7-61613 3/1995

* cited by examiner

*Primary Examiner*—David H Bollinger
(74) *Attorney, Agent, or Firm*—Fitzpatrick, Cella, Harper & Scinto

(57) ABSTRACT

A sheet feeding apparatus in which a first sheet feeding cassette and a second sheet feeding cassette for containing sheets are arranged in a vertical direction, a first drawer and a second drawer for holding the first sheet feeding cassette and the second sheet feeding cassette, respectively, such that they can be drawn out, a second sheet feeding roller for feeding the sheets from the second sheet feeding cassette located below the first sheet feeding cassette is arranged lateral to the first drawer of the first sheet feeding cassette located above the second sheet feeding cassette so as to be positioned above the bottom surface of the first sheet feeding cassette, and a second sheet feeding unit is supported by being abutted against the first drawer of the first sheet feeding cassette.

8 Claims, 7 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly, to a sheet feeding apparatus and an image forming apparatus including a plurality of sheet containing devices mounted one above another with an overlap in a vertical direction.

2. Related Background Art

Up to now, in an image forming apparatus provided with a sheet feeding apparatus including a sheet containing device such as a sheet feeding cassette, sheets are stacked on a plurality of sheet feeding cassettes which are detachably mounted to an apparatus main body one above another with an overlap in a vertical direction, and are sequentially fed to an image forming portion, and then an image is formed on a sheet at the image forming portion.

In such the image forming apparatus, as disclosed in Japanese Patent Application Laid-open No. H07-61613, sheets with different sizes are contained correspondingly in the plurality of sheet feeding cassettes mounted one above another with an overlap in a vertical direction, and the sheets are selectively fed to an image forming portion from the plurality of sheet feeding cassettes according to a designated size of the sheet.

FIG. 6 shows a structure of a conventional image forming apparatus including a plurality of (two) sheet feeding cassettes overlapping with each other in the vertical direction. An upper and lower sheet feeding cassettes 105 and 109 are detachably contained in a width direction with respect to the apparatus main body 100 by a cassette drawer device 108 and 112 for slidably holding the sheet feeding cassettes 105 and 109 in a direction orthogonal to a sheet feeding direction (hereinafter referred to as "width direction").

Sheets S contained in the sheet feeding cassettes 105 and 109 are fed out by sheet feeding rollers 106 and 110 which are driven by a driving transmission apparatus to be rotated, and then are separated one by one by separating units 107 and 111. After that, the separated sheets are conveyed to an image forming unit 104. It should be noted that in FIG. 6, a partition plate 113 partitions the upper sheet feeding cassette 105 and the lower sheet feeding cassette 109. The lower sheet feeding roller 110 is positioned below the partition plate 113, that is, below a bottom of the upper sheet feeding cassette 105.

It should be noted that the cassette drawer devices 108 and 112, which detachably accommodate the sheet feeding cassettes 105 and 109 arranged in the vertical direction, has a structure as shown in FIGS. 7A, 7B, and 7C. FIG. 7A is a front view showing the cassette drawer device 108, 112 viewed from a direction toward which the cassette is drawn out therefrom. FIGS. 7B and 7C are perspective views showing a state in which the sheet feeding cassette 105, 109 is mounted in the cassette drawer device 108, 112 and a state in which the sheet feeding cassettes 105, 109 are drawn out from the-cassette drawer device 108, 112, respectively.

As shown in FIGS. 7A to 7C, the cassette drawer device 108 (108L and 108R), 112 (112L and 112R) is arranged outside the sheet feeding cassette 105, 109, and includes a base member 108*a*, 112*a* that is fixed on a front-and-rear side plate 100*a*, 100*b* of the apparatus main body 100 (refer to FIG. 6) and a slide member 108*b*, 112*b* that is slidably held in the base member 108*a*, 112*a*.

The sheet feeding cassette 105, 109 is mounted to the slide member 108*b*, 112*b*, thereby being detachably mounted into the apparatus main body 100 through the intermediation of the cassette drawer device 108, 112.

However, in such the conventional sheet feeding apparatus and the image forming apparatus, when the plurality of sheet feeding cassettes are provided one above another with an overlap in a vertical direction, a height of the apparatus main body increases. When the height of the apparatus main body thus increases, for example, in a case of a multifunction printer provided with a scanner or the like on a top surface of the apparatus main body, there is a problem in that a position of an original table for stacking an original is higher, and operability thereof deteriorates.

On the other hand, in the conventional image forming apparatus, a sheet feeding unit provided with sheet feeding rollers 106 and 110 is fixed to a feed frame (not shown) provided to the apparatus main body 100. In this case, it is widely recognized that rigidity of the sheet feeding unit has much to do with a sheet feeding performance and image quality.

For example, in a sheet feeding and separating operation, when the sheet feeding unit receives a reaction force from the separating units 107 and 111 through the sheet feeding rollers 106 and 110 and is deformed by the reaction force, a failure in sheet feeding or skew feeding of sheets is caused. As a result, deterioration in image quality or the like is caused.

SUMMARY OF THE INVENTION

The present invention has been made in view of the above problems, and therefore has an object to provide a sheet feeding apparatus and an image forming apparatus which are capable of reducing a height of an apparatus main body and securing an image quality.

It is an object of the present invention to provide a sheet feeding apparatus including: a first sheet containing device and a second sheet containing device which are detachably mountable to an apparatus main body and said second sheet containing device is located below said first sheet containing device; a first sheet feeding unit and a second sheet feeding unit capable to feed sheets stacked on said first sheet containing device and said second sheet containing device, respectively; a first holding device and a second holding device capable to hold said first sheet containing device and said second sheet containing device, respectively, slidably in a direction orthogonal to a sheet feeding direction; and wherein said second sheet feeding unit is arranged lateral to said first holding device of said first sheet containing device so that said second sheet feeding unit is provided to be able to abut against said first holding device.

DESCRIPTION OF THE PREFERRED EMBODIMENTS

Hereinafter, best modes for implementing the present invention will be described with reference to the accompanying drawings.

Figure 1:
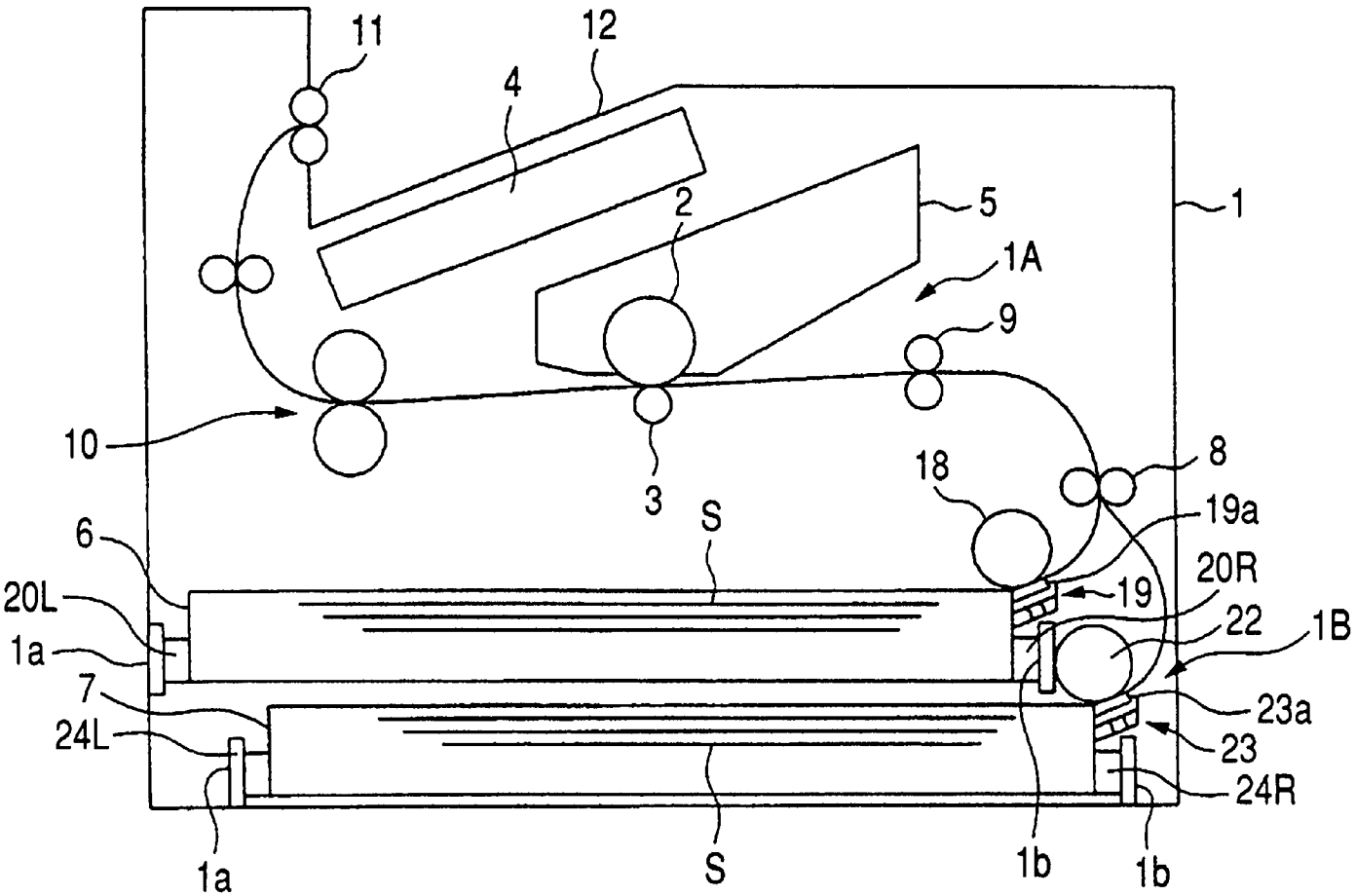
FIG. 1 is a diagram showing a schematic structure of an image forming apparatus provided with a sheet feeding apparatus according to a first embodiment of the present invention.

FIG. 1 shows a schematic structure of an image forming apparatus provided with a sheet feeding apparatus according to a first embodiment of the present invention.

In FIG. 1, an image forming apparatus main body (hereinafter referred to as "apparatus main body") 1 includes an image forming portion 1A for forming an image by an electrophotographic process and a sheet feeding apparatus 1B for feeding a sheet S to the image forming portion 1A.

The image forming portion 1A includes a photosensitive drum 2 on which a toner image is formed and a transfer roller 3 for transferring the toner image formed on the photosensitive drum 2 onto the sheet S. In the image forming portion 1A thus structured, when an image forming operation is started, light corresponding to an image signal is first applied to the photosensitive drum 2 by a laser scanner 4. By thus applying light corresponding to the image signal, a latent image is formed on the photosensitive drum 2. Then, the latent image is developed by a toner contained in a process cartridge 5, thereby forming a toner image (visible image) on the photosensitive drum 2.

Further, the sheet feeding apparatus 1B includes a sheet feeding cassette 6 serving as a first sheet containing device and a sheet feeding cassette 7 serving as a second sheet containing device, which are a plurality of (two in this embodiment) sheet feeding devices detachably mounted to the apparatus main body 1 one above another with an overlap in a vertical direction. The sheet feeding apparatus 1B further includes a sheet feeding roller 18 serving as a first sheet feeding device and a sheet feeding roller 22 serving as a second sheet feeding device, for feeding the sheets S stored in sheet feeding cassettes 6 and 7. The sheet feeding rollers 18 and 22 are driven by a driving transmission apparatus to be rotated simultaneously with the above-mentioned toner image forming operation, thereby feeding the sheet S from the sheet feeding cassettes 6 and 7.

The sheets S fed from the sheet feeding cassettes 6 and 7 are fed into separating units 19 and 23 serving as separating devices which are provided to the sheet feeding cassettes 6 and 7 and which include separating pads 19*a* and 23*a* for separating sheets one from another by press-contacting the sheets with the sheet feeding rollers 18 and 22. In each of the separating units 19 and 23, one of the sheets S is separated from another. After that, the separated sheet is conveyed to a transferring part constituted of the photosensitive drum 2 and the transfer roller 3 in synchronism with the image formed on the photosensitive drum 2 by a conveying roller 8 and a registration roller 9. Then, in the transferring part, a bias is applied to the transfer roller 3, thereby transferring a toner image onto the sheet S.

It should be noted that the sheet S onto which the toner image is thus transferred is then conveyed to a fixing means 10. The conveyed sheet S is pressurized and heated in the fixing means 10, thereby fixing the toner image. After that, the sheet S is delivered to a delivery part 12, which is an upper part of the apparatus, by a delivery roller 11.

In this case, the upper and lower sheet feeding cassettes 6 and 7 each are detachably mounted to the apparatus main body 1, in other words, a sheet feeding apparatus main body (not shown), through the intermediation of drawer means 20 (20R and 20L) serving as a first holding device for slidably holding the sheet feeding cassette 6 in a width direction, and a drawer device 24 (24R and 24L) serving as a second holding device for slidably holding the sheet feeding cassette 7 in the width direction. The cassette drawer devices 20 and 24 have such structures as shown in FIGS. 2A, 2B, and 2C.

Figure 2A:
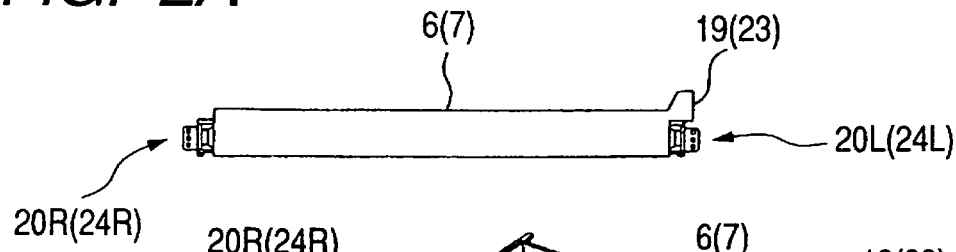
FIGS. 2A, 2B, and 2C are diagrams for explaining a cassette drawer device provided to the image forming apparatus.

FIG. 2A is a front view showing the cassette drawer device 20, 24 viewed from a direction toward which the cassette is drawn out therefrom. FIGS. 2B and 2C are perspective views showing a state in which a sheet feeding cassette 6, 7 is mounted in the cassette drawer device 20, 24 and a state in which the sheet feeding cassette 6, 7 is drawn out from the cassette drawer device 20, 24, respectively.

Figure 2B:
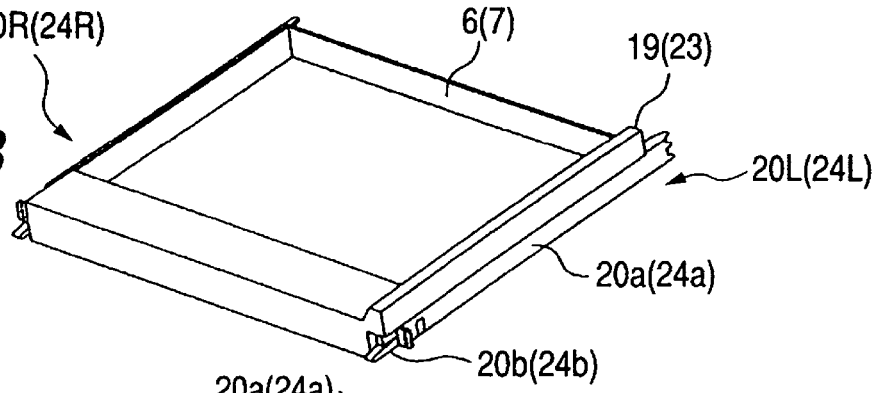
Figure 2C:
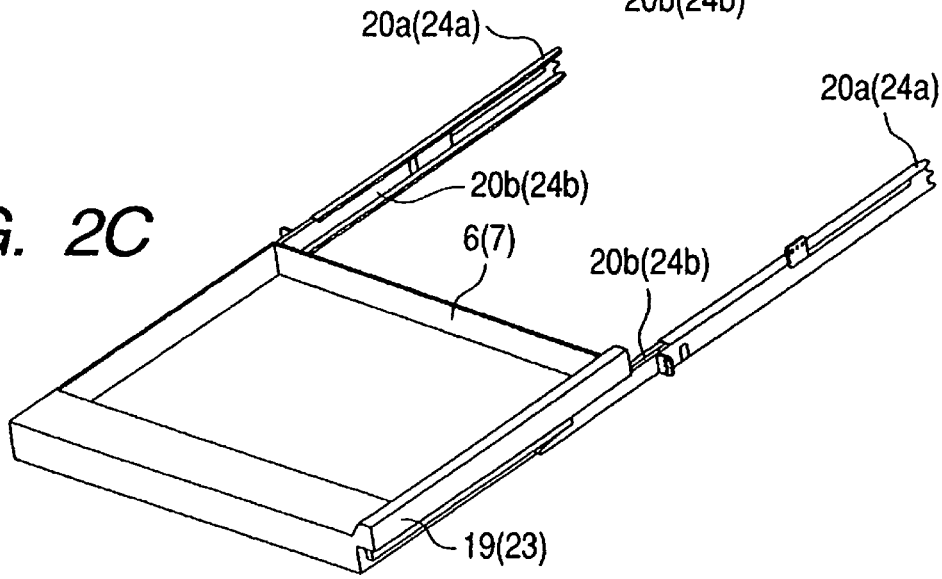

As shown in FIGS. 2A to 2C, the cassette drawer device 20, 24 is arranged outside the sheet feeding cassette 6, 7, and includes a base-member 20*a*, 24*a* that is fixed on a front-and-rear side plate 1*a*, 1*b* (refer to FIG. 1) and a slide member 20*b*, 24*b* that is slidably held in the base member 20*a*, 24*a*. The sheet feeding cassette 6, 7 is mounted to the slide member 20*b*, 24*b*, thereby being detachably mounted into the apparatus main body 1 through the intermediation of the cassette drawer device 20, 24. The base member 20*a*, 24*a* is formed to have a C-shape cross section, and when mounting the sheet feeding cassettes 6 and 7, the slide members 20*b* and 24*b* slidably contact with inner sides thereof, so the cassette drawer devices 20 and 24 have a high rigidity as a whole.

In this embodiment, as shown in FIGS. 1 and 2A, the cassette drawer devices 20 and 24 are arranged below the separating units 19 and 23 of the sheet feeding cassettes 6 and 7, respectively, and at the same time, are arranged on the same surfaces as bottom surfaces of the sheet feeding cassettes 6 and 7 or above the bottom surfaces of the sheet feeding cassettes 6 and 7, respectively. By thus arranging the cassette drawer devices 20 and 24, it is possible to shorten the length of the apparatus main body 1 in the sheet feeding direction.

Figure 3:
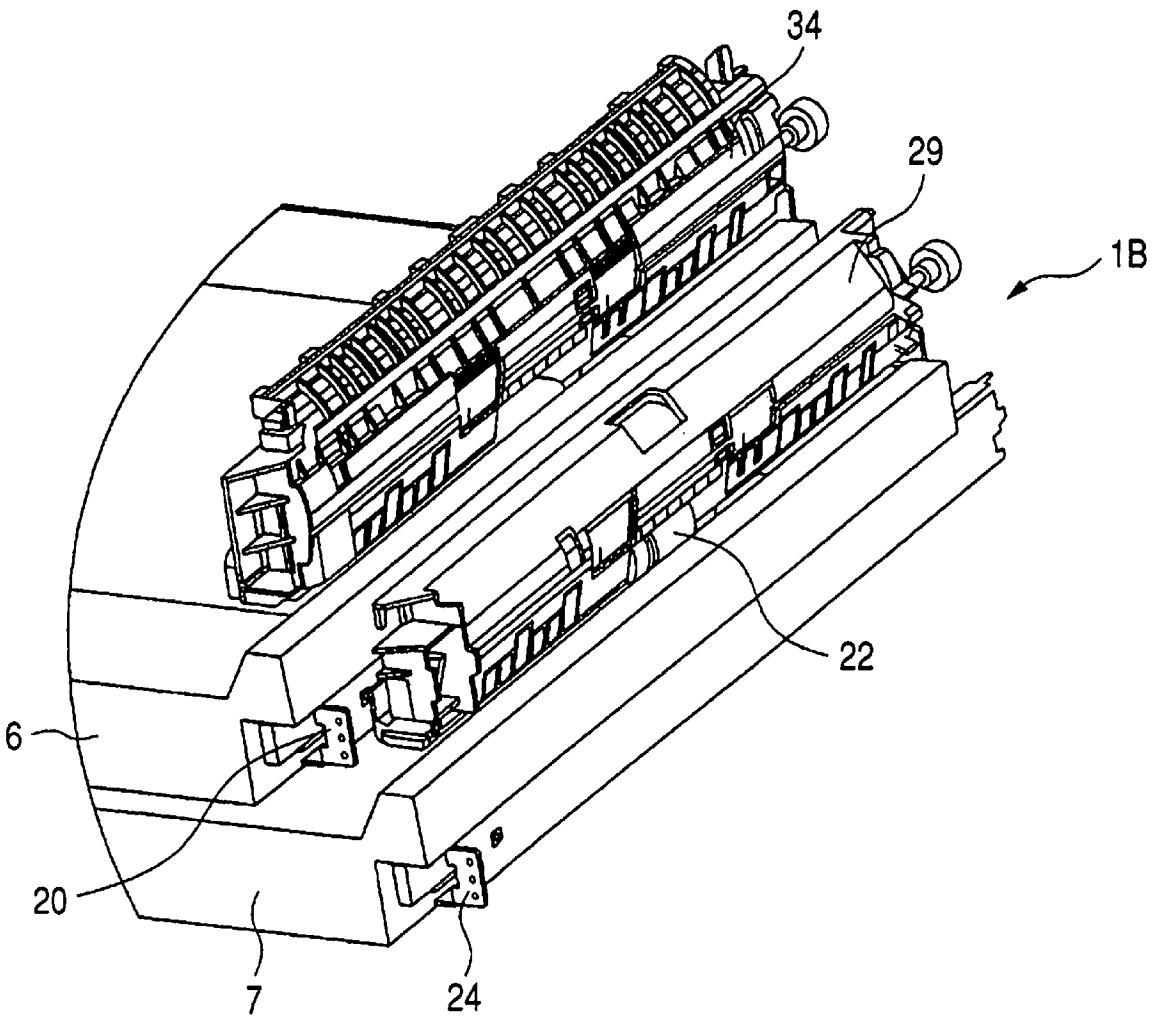
FIG. 3 is a perspective view of substantial parts of the sheet feeding apparatus.

Further, in this embodiment, the sheet feeding roller 22 for the lower sheet feeding cassette 7 serving as a sheet containing device located at a lower part of the sheet feeding apparatus is protruded above the bottom surface of the upper sheet feeding cassette 6 serving as a sheet containing device which is immediately above the sheet feeding cassette 7, and at the same time, the sheet feeding roller 22 is arranged beside the drawer device 20 for the upper sheet feeding cassette 6 as shown in FIG. 3. In FIG. 3, a sheet feeding unit 29 includes the sheet feeding roller 22 for the lower sheet feeding cassette 7, and a sheet feeding unit 34 includes the sheet feeding roller 18 for the upper sheet feeding cassette 6.

As described above, the-sheet feeding roller 22 for the lower sheet feeding cassette 7 is arranged beside the drawer device 20 for the upper sheet feeding cassette 6 to be protruded above the bottom surface of the upper sheet feeding cassette 6, to thereby make it possible to cause the upper sheet feeding cassette 6 to overlap with the sheet feeding roller 22 for the lower sheet feeding cassette 7 in the height direction. Thus, the height of the apparatus main body 1 can be reduced by the overlapping amount.

Figure 6:
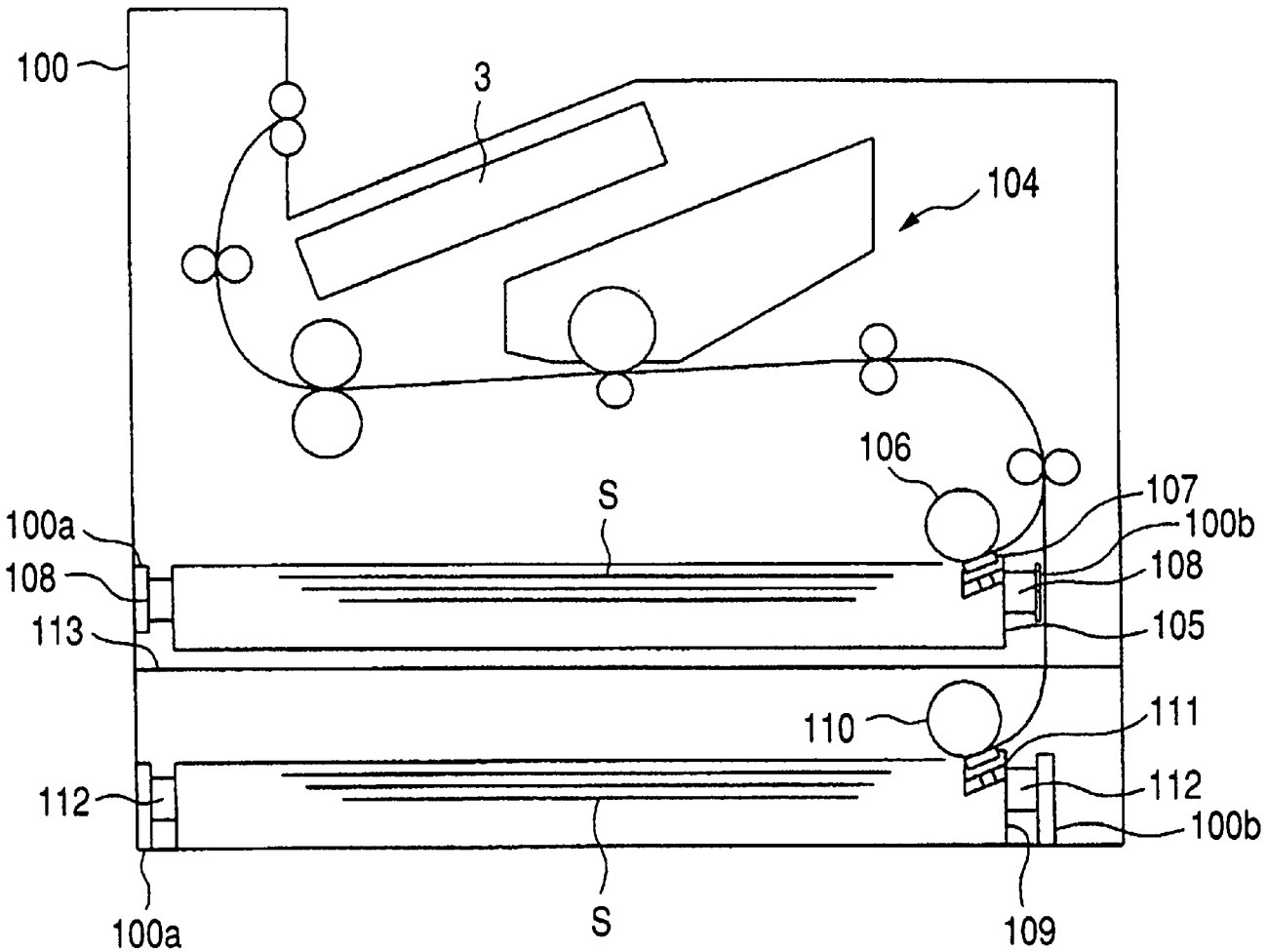
FIG. 6 is a diagram showing a schematic structure of a conventional image forming apparatus.
Figure 7A:
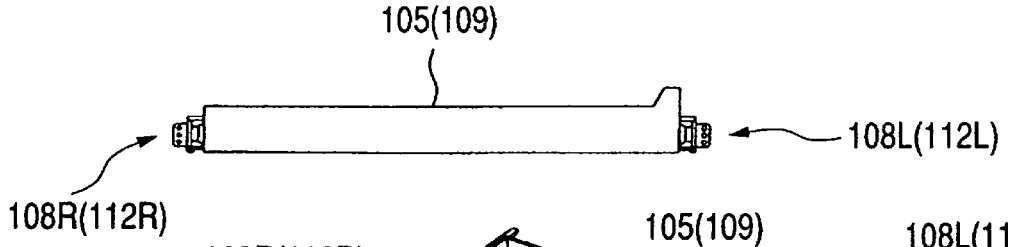
FIGS. 7A, 7B, and 7C are diagrams for explaining a cassette drawer device of the conventional image forming apparatus.
Figure 7B:
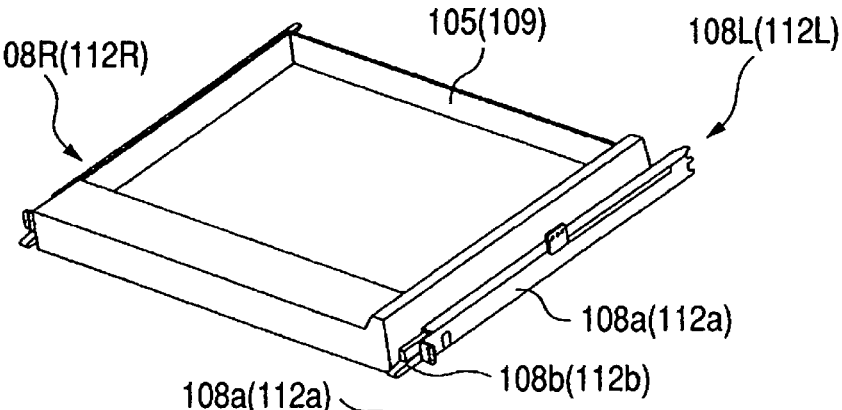
Figure 7C:
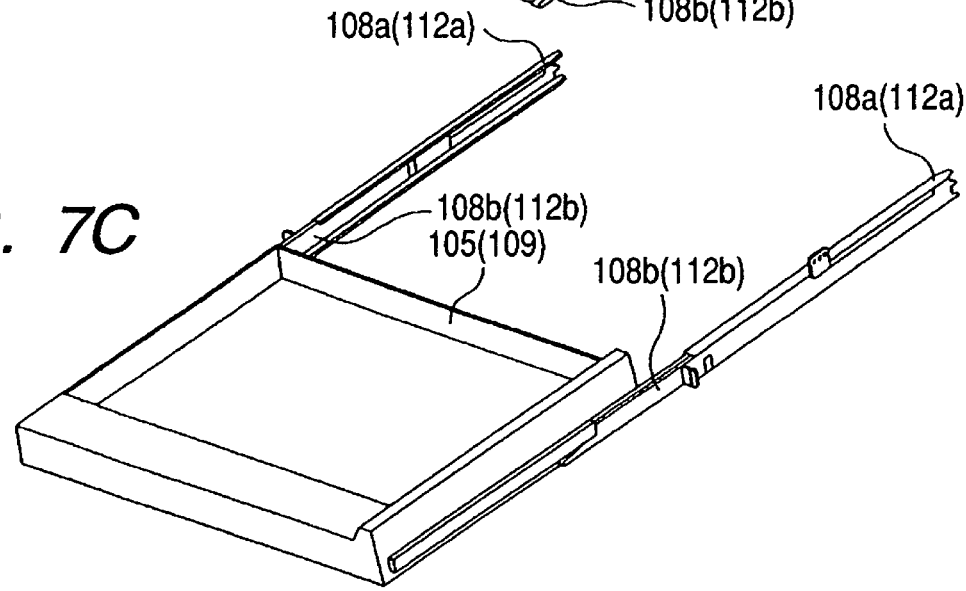

It should be noted that the partition plate 113 interposed between the cassettes (refer to FIG. 6) is removed, or an opening portion in which the sheet feeding roller 22 can be arranged is provided to the partition plate 113 so that the sheet feeding roller 22 for the lower sheet feeding cassette 7 can be arranged beside the drawer device 20 for the upper sheet feeding roller 6 to be protruded above the bottom surface of the upper sheet feeding cassette 6.

On the other hand, the sheet feeding units 29 and 34 which include the sheet feeding rollers 18 and 22 receive a reaction force from the separating units 19 and 23 through the sheet feeding rollers 18 and 22, respectively, for example, in the sheet feeding and separating operation.

Figure 4:
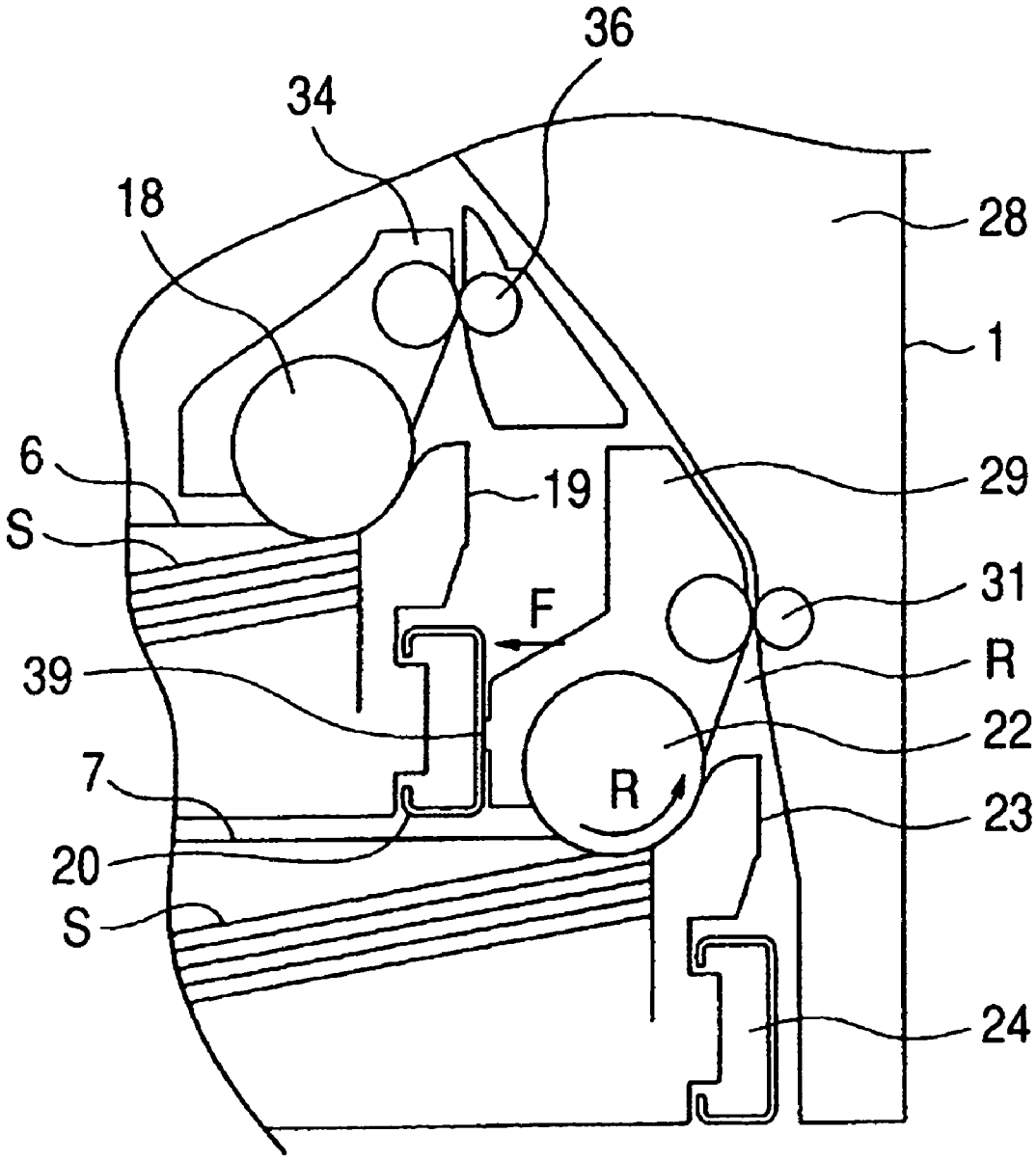
FIG. 4 is a cross-sectional view of substantial parts of the sheet feeding apparatus.

When the sheet feeding units 29 and 34 receive such the reaction force, the sheet feeding unit 34 of the upper cassette 6 can be firmly fixed to, for example, a frame (not shown) of the apparatus main body 1. On the other hand, as shown in FIG. 4, the sheet feeding unit 29 of the lower cassette 7 is sandwiched between the cassette drawer device 20 for the upper cassette 6 and an external unit 28 for forming a sheet transport path R, which makes it difficult for the sheet feeding unit 29 of the lower cassette 7 to be firmly held to the frame or the like.

In this embodiment, on sheet feeding, the lower sheet feeding unit 29 is provided with a bumping portion 39 which hits against the cassette drawer device 20 for the upper sheet feeding cassette 6 when the lower sheet feeding unit 29 receives the reaction force from the separating unit 23. By providing such the bumping portion 39, in the sheet feeding operation of the lower sheet feeding unit 29, when the lower sheet feeding unit 29 receives the reaction force indicated by the arrow F from the separating unit 23, the bumping portion 39 hits (abuts) against the cassette drawer device 20 for the upper sheet feeding cassette 6.

When receiving the reaction force, the lower sheet feeding unit 29 hits against the cassette drawer device 20 which has a high rigidity and is a part of structures of the apparatus main body 1, thereby making it possible to prevent the sheet feeding unit 29 from being deformed. Thus, skew feeding of the sheet S or the like at the time of sheet feeding can be prevented, thereby enhancing the sheet feeding performance. As a result, the image quality can be secured. It should be noted that the bumping portion 39 might be provided to the cassette drawer device 20 for the upper sheet feeding cassette 6 instead of being provided to the sheet feeding unit 29.

As described above, when the sheet feeding roller 22 for the lower sheet feeding cassette 7 is arranged beside the cassette drawer device 20 for the upper sheet feeding cassette 6 to be protruded above the bottom surface of the upper sheet feeding cassette 6, and sheet feeding unit 29 of the lower sheet feeding cassette 7 is brought into contact with the cassette drawer device 20 for the upper sheet feeding cassette 6, the height of the apparatus main body 1 can be reduced, and the deformation of the sheet feeding unit 29 can be prevented, thereby making it possible to secure the image quality.

As described above, in the case where the sheet feeding roller 22 for the lower sheet feeding cassette 7 is arranged beside the cassette drawer device 20 for the upper sheet feeding cassette 6 to be protruded above the bottom surface of the upper sheet feeding cassette 6, there is a space between a back end of the lower sheet feeding cassette 7 in the sheet feeding direction and the apparatus main body 1 as shown in FIG. 1.

For example, by increasing the length of the lower sheet feeding cassette 7 in the sheet feeding direction, the space formed between the back end of the lower sheet feeding cassette 7 in the sheet feeding direction and the apparatus main body 1 can be effectively utilized. In addition, by increasing the length of the lower sheet feeding cassette 7 as described above, the size of the sheet contained in the sheet feeding cassette 7 can be increased.

Next, described as an example of the lower sheet feeding cassette 7 is a second embodiment of the present invention which employs a lower sheet feeding cassette having a length longer in the sheet feeding direction.

Figure 5:
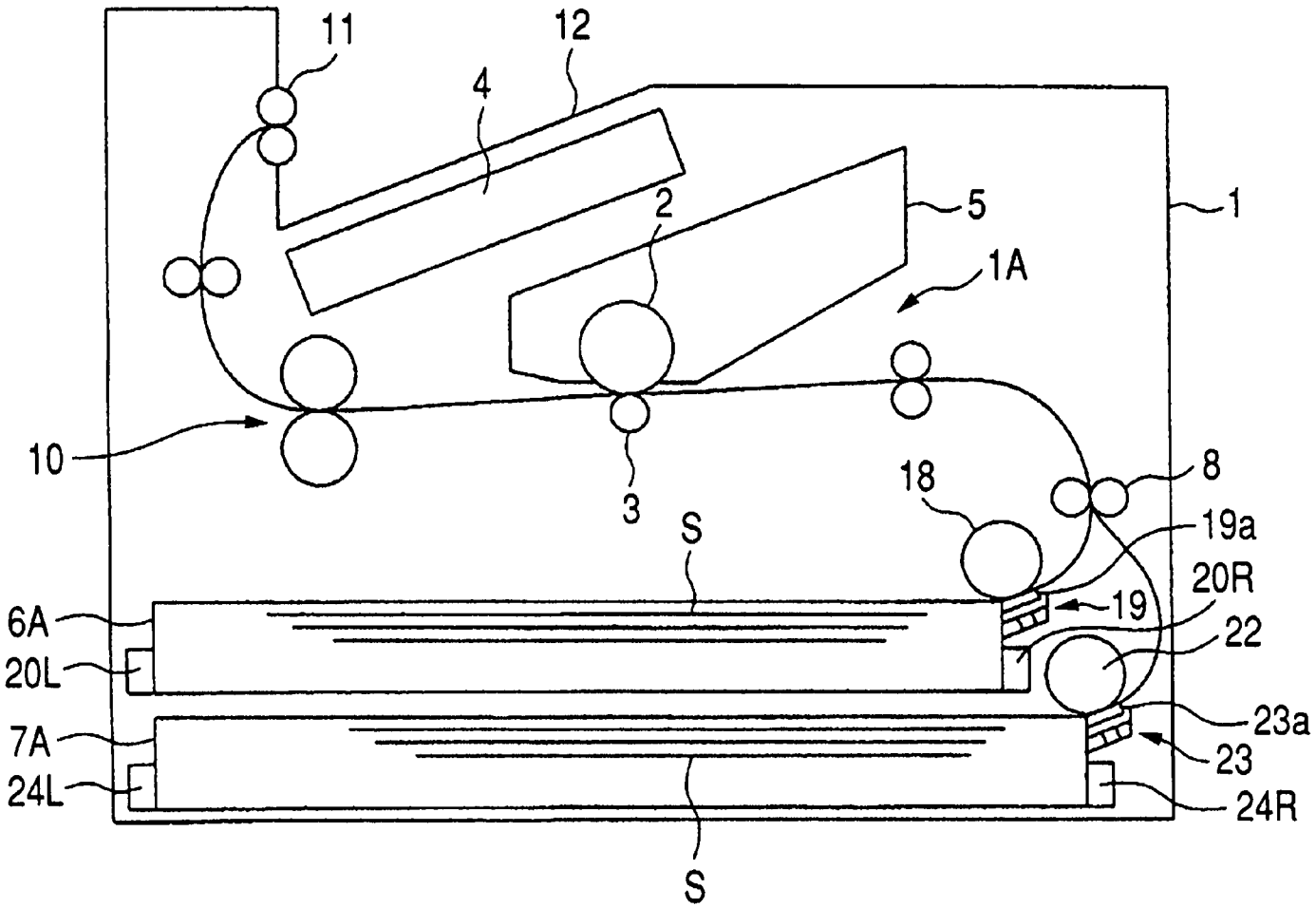
FIG. 5 is a diagram showing a schematic structure of an image forming apparatus provided with a sheet feeding apparatus according to a second embodiment of the present invention.

FIG. 5 shows a schematic structure of an image forming apparatus including a sheet feeding apparatus according to the second embodiment of the present invention. In FIG. 5, the identical reference symbols with those of FIG. 1 indicate the identical or equivalent parts.

In FIG. 5, a plurality of (two in this embodiment) sheet feeding cassettes 6A and 7A serving as a sheet containing device are detachably mounted to the apparatus main body 1 one above another with an overlap in a vertical direction. In this embodiment, the lower sheet feeding cassette 7A has a length longer in the sheet feeding direction than the upper sheet feeding cassette 6A.

It should be noted that in this embodiment, the lower sheet feeding cassette 7A can contain sheets with a size ranging, for example, from A5 (148.5 mm×210 mm) to LDR (279 mm×432 mm), and the upper sheet feeding cassette 6A can contain sheets with a size ranging, for example, from a minimum size to B4 (257 mm×364 mm).

By thus increasing the length of the lower sheet feeding cassette 7A, the space formed at the left side of the lower cassette 7A can be effectively utilized, and at the same time, the number of types of sheets contained in the sheet feeding cassettes 6A and 7A can be increased. It should be noted that the case where the two sheet feeding cassettes are employed is described in this embodiment, but the present invention can also be applied to a case where more than two sheet feeding cassettes are provided.

This application claims priority from Japanese Patent Application No. 2005-128407 filed on Apr. 26, 2005, which is hereby incorporated by reference.

What is claimed is:

1. A sheet feeding apparatus, comprising:

a first sheet containing device and a second sheet containing device which are detachably mountable to an apparatus main body and said second sheet containing device is located below said first sheet containing device;

a first sheet feeding unit and a second sheet feeding unit capable to feed sheets stacked on said first sheet containing device and said second sheet containing device, respectively; and a first holding device and a second holding device arranged lateral to said first sheet containing device and said second sheet containing device, respectively, and being capable to hold said first sheet containing device and said second sheet containing device, respectively, slidably in a direction orthogonal to a sheet feeding direction, wherein said second sheet feeding unit is arranged lateral to said first holding device of said first sheet containing device so that a bumping portion of said second sheet feeding unit is provided to be able to abut against said first holding device.

2. A sheet feeding apparatus according to claim 1, wherein said first sheet containing device has a separating device for separating sheets fed out from said first sheet feeding unit one by one, and said first holding device for holding said first sheet containing device is arranged below said separating device.

3. A sheet feeding apparatus according to claim 1, wherein said first holding device and said second holding device each comprises:

a base member mounted to the apparatus main body; and a slide member which is attached to a corresponding one of said first sheet containing device and said second sheet containing device and is slidably supported by said base member.

4. A sheet feeding apparatus according to claim 1, further comprising a partition plate interposed between said first sheet containing device and said second sheet containing device, wherein said partition plate is provided with an opening portion through which a sheet feeding roller of said second sheet containing device is extended.

5. An image forming apparatus, comprising:

a first sheet containing device and a second sheet containing device which are detachably mountable to an apparatus main body of said image forming apparatus and said second sheet containing device is located below said first sheet containing device;

a first sheet feeding unit and a second sheet feeding unit capable to feed sheets stacked on said first sheet containing device and said second sheet containing device, respectively;

a first holding device and a second holding device capable to hold said first sheet containing device and said second sheet containing device, respectively, slidably in a direction orthogonal to a sheet feeding direction; and an image forming portion for forming an image on a sheet fed out from said first sheet containing device and said second sheet containing device, wherein said second sheet feeding unit is arranged lateral to said first holding device of said first sheet containing device so that a bumping portion of said second sheet feeding unit is provided to be able to abut against said first holding device.

6. An image forming apparatus according to claim 5, wherein said first sheet containing device has a separating device for separating sheets fed out from said first sheet feeding unit one by one, and said first holding device for holding said first sheet containing device is arranged below said separating device.

7. An image forming apparatus according to claim 5, wherein said first holding device and said second holding device each comprises:

a base member mounted to the apparatus main body; and a slide member which is attached to a corresponding one of said first sheet containing device and said second sheet containing device and is slidably supported by said base member.

8. An image forming apparatus according to claim 5, further comprising a partition plate interposed between said first sheet containing device and said second sheet containing device, wherein said partition plate is provided with an opening portion through which a sheet feeding roller of said second sheet containing device is extended.

* * * * *